US007739750B2

(12) United States Patent
Nelson et al.

(10) Patent No.: US 7,739,750 B2
(45) Date of Patent: Jun. 22, 2010

(54) GARMENT PREPARED FROM FLUOROPOLYMER STAPLE YARN

(75) Inventors: Arthur Russell Nelson, Decatur, AL (US); Mike Donckers, Decatur, AL (US)

(73) Assignee: Toray Fluorofibers (America), Inc., Decatur, AL (US)

( * ) Notice: Subject to any disclaimer, the term of this patent is extended or adjusted under 35 U.S.C. 154(b) by 0 days.

(21) Appl. No.: 12/014,465

(22) Filed: Jan. 15, 2008

(65) Prior Publication Data

US 2009/0178187 A1 Jul. 16, 2009

(51) Int. Cl.
*A62B 17/00* (2006.01)

(52) U.S. Cl. ..... 2/81

(58) Field of Classification Search ..... 2/69, 2/81, 102, 167, 2.5, 16, 59
See application file for complete search history.

(56) References Cited

U.S. PATENT DOCUMENTS 4,302,496 A 11/1981 Donovan
4,569,088 A * 2/1986 Frankenburg et al. ..... 2/81
4,901,370 A 2/1990 Suda
4,943,473 A * 7/1990 Sahatjian et al. ..... 442/289
5,007,112 A 4/1991 Lewis, Jr. et al.
5,014,357 A 5/1991 Wiseman, Sr.
5,050,241 A 9/1991 Flowers et al.
5,210,878 A 5/1993 Triche
5,223,334 A * 6/1993 Green ..... 442/214
5,691,040 A * 11/1997 Barbeau et al. ..... 428/198
5,715,536 A 2/1998 Banks
5,960,475 A 10/1999 Fewtrell
5,996,122 A 12/1999 Aldridge et al.
2005/0144694 A1 7/2005 Aldridge et al.
2005/0251900 A1 11/2005 Harlacker
2006/0021118 A1 2/2006 Culler et al.

FOREIGN PATENT DOCUMENTS

EP 0157140 A1 10/1985
EP 0272952 A2 6/1988

* cited by examiner

*Primary Examiner*—Tejash Patel
(74) *Attorney, Agent, or Firm*—C. Brandon Browning; Maynard, Cooper & Gale, PC

(57) ABSTRACT

A single layer, lightweight protective garment prepared from a fabric made of woven polytetrafluoroethylene staple fiber yam, the fabric having an outer surface composed fluoropolymer staple fibers.

17 Claims, 8 Drawing Sheets

GARMENT PREPARED FROM FLUOROPOLYMER STAPLE YARN

FIELD OF THE INVENTION

The present invention relates to a garment that resists burn-though caused by molten metal splash, sparks and electrical arcs and more particularly to a single ply garment prepared from a fabric made from spun fluoropolymer staple fibers or continuous filament yarns.

BACKGROUND OF THE INVENTION

Protective or hazardous duty garments are widely used in various industries to protect the wearer from hazardous conditions, such as heat, smoke, cold, sharp objects, chemicals, liquids, fumes and the like. For example, foundry workers and others who work with molten metal require garments which protect not only from the high temperatures encountered in their work areas but also from occasional splashes of molten metal, particularly high-melting metals such as aluminum and iron. In such instances, if the molten metal adheres to the garment, a great deal of heat is transferred through the garment to the wearer unless the fabric comprising the garment is so thick as to be excessively cumbersome and uncomfortable to wear.

One example of a protective garment for foundry workers is disclosed in U.S. Pat. No. 4,569,088 to Frankenburg et al. which describes a garment prepared from a composite fabric comprised of an outer layer including a needled batt of polytetrafluoroethylene fibers attached throughout its interface by needling with an inner layer of infusible textile fibers selected from the group consisting of poly(m-phenylene isophthalamide) fibers, poly(p-phenylene terephthalamide) fibers and blends thereof. The outer surface is provided to protect the inner durable fabric layer and to provide a surface upon which molten metal splash will not adhere.

SUMMARY OF THE INVENTION

The present invention is directed to a lightweight protective garment made of a fabric having an exterior surface that readily sheds molten metal splash and sparks, resists burn-through caused thereby and exhibits improved dimensional heat stability. The fabric is made from woven or knit spun fluoropolymer staple yarn that can be produced, for example, by matrix spinning or paste extrusion, which may form expanded polytetrafluoroethylene staple or non-expanded staple fibers. Preferably, the spun fluoropolymer staple yarn is matrix spun polytetrafluoroethylene staple yarn.

DETAILED DESCRIPTION OF PRESENTLY PREFERRED EMBODIMENTS

Figure 1:
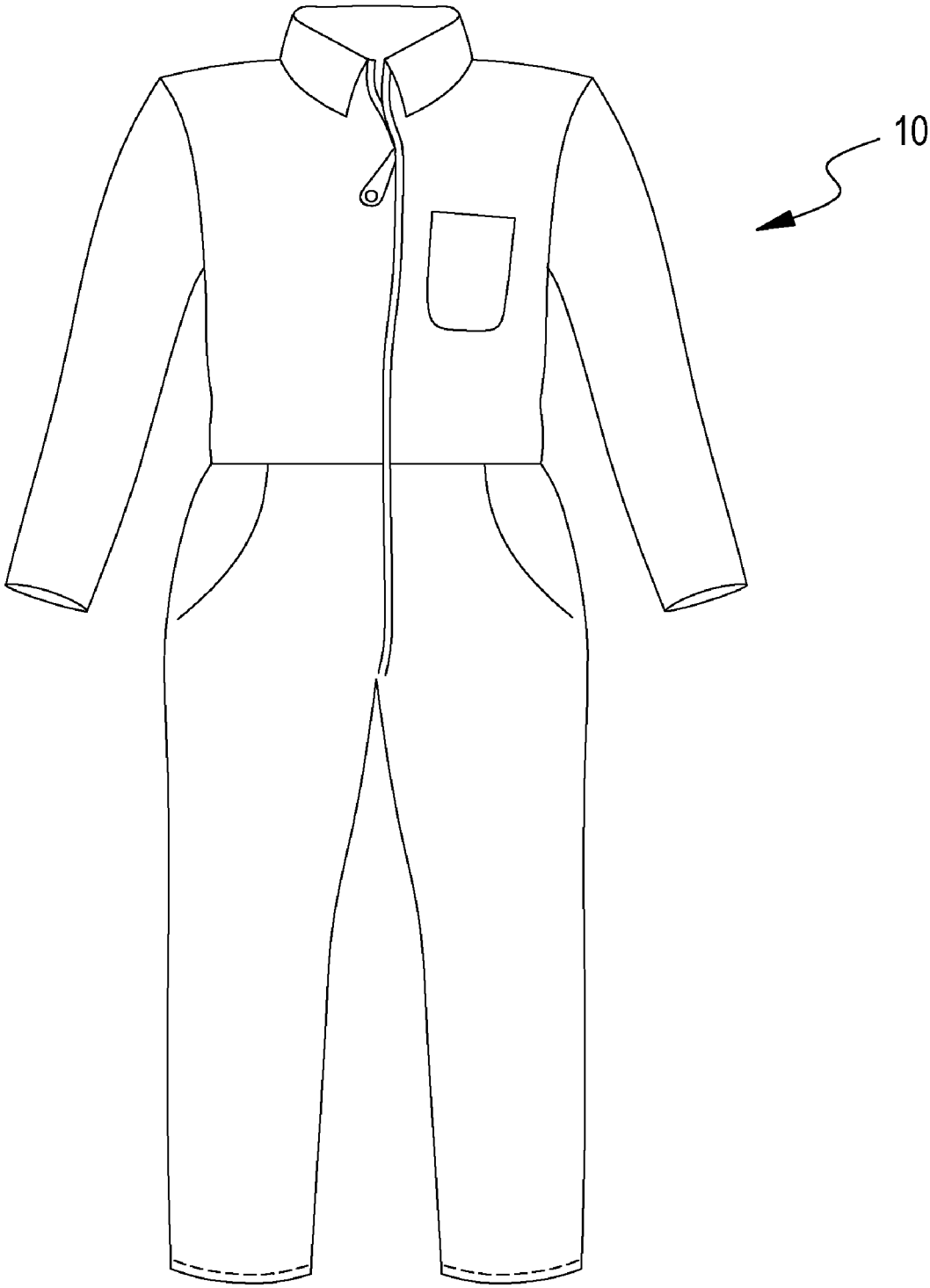
FIG. 1 is a protective garment according to the present invention.
Figure 2A:
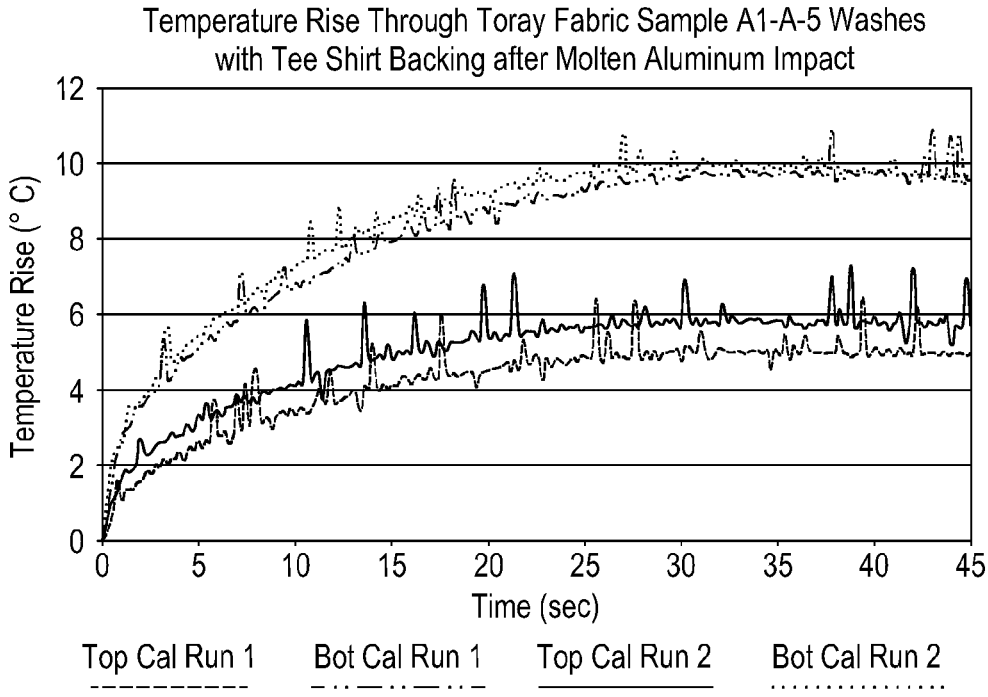
FIG. 2(A) graphically illustrates the temperature rise to a calorimeter through test fabric Al-A-5 washes with tee shirt backing to molten metal impact.
Figure 2B:
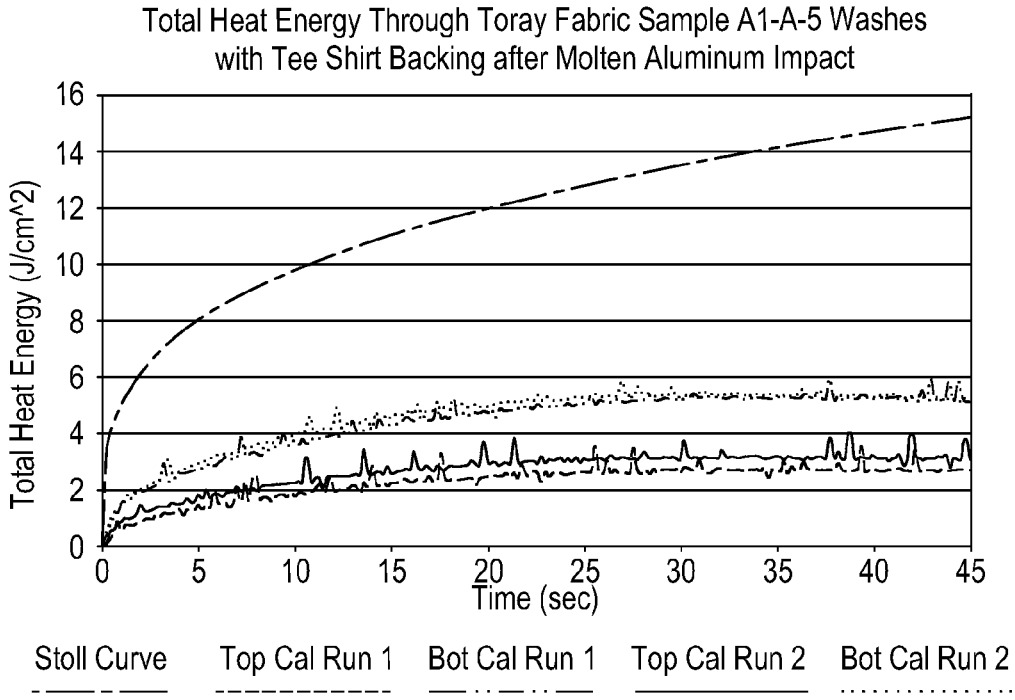
FIG. 2(B) graphically illustrates the total heat energy to a calorimeter through test fabric Al-A-5 washes with tee shirt backing to molten metal impact.
Figure 3A:
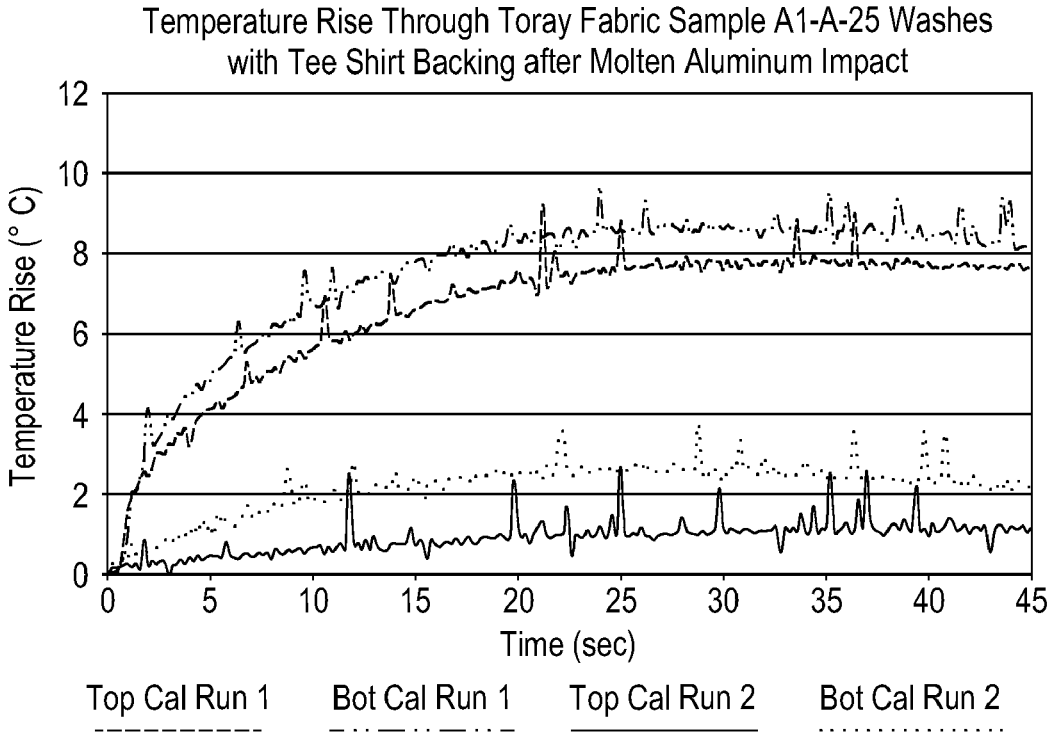
FIG. 3(A) graphically illustrates the temperature rise to a calorimeter through test fabric Al-A-25 washes with tee shirt backing to molten metal impact.
Figure 3B:
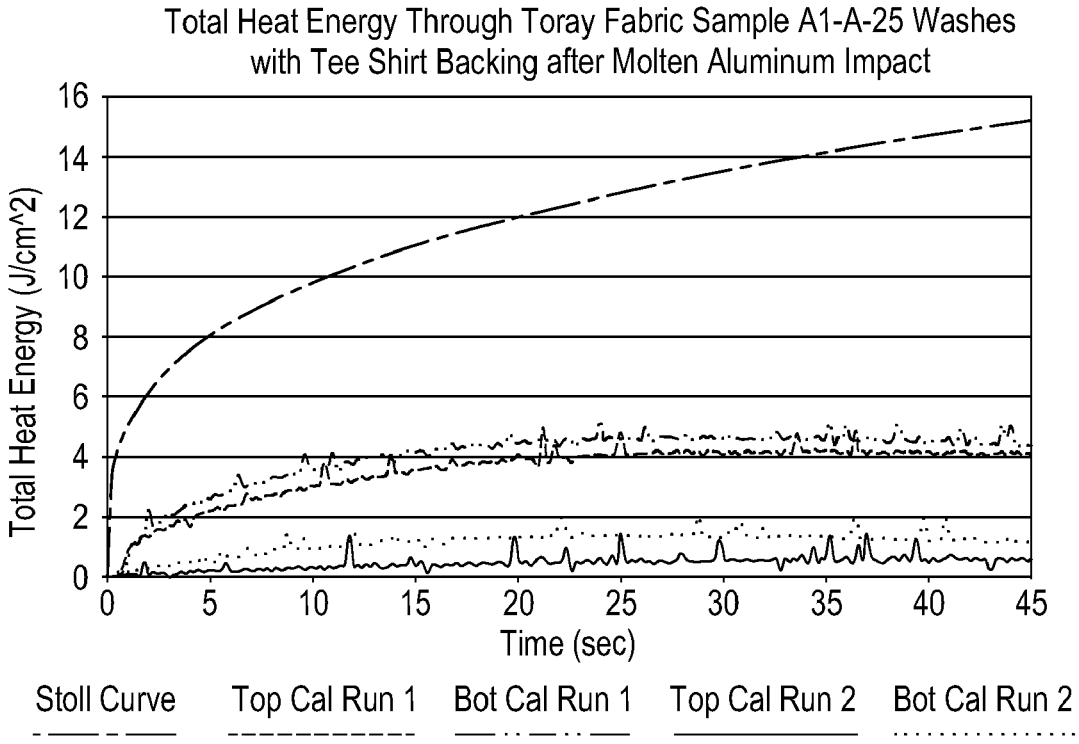
FIG. 3(B) graphically illustrates the total heat energy to a calorimeter through test fabric Al-A-25 washes with tee shirt backing to molten metal impact.
Figure 4A:
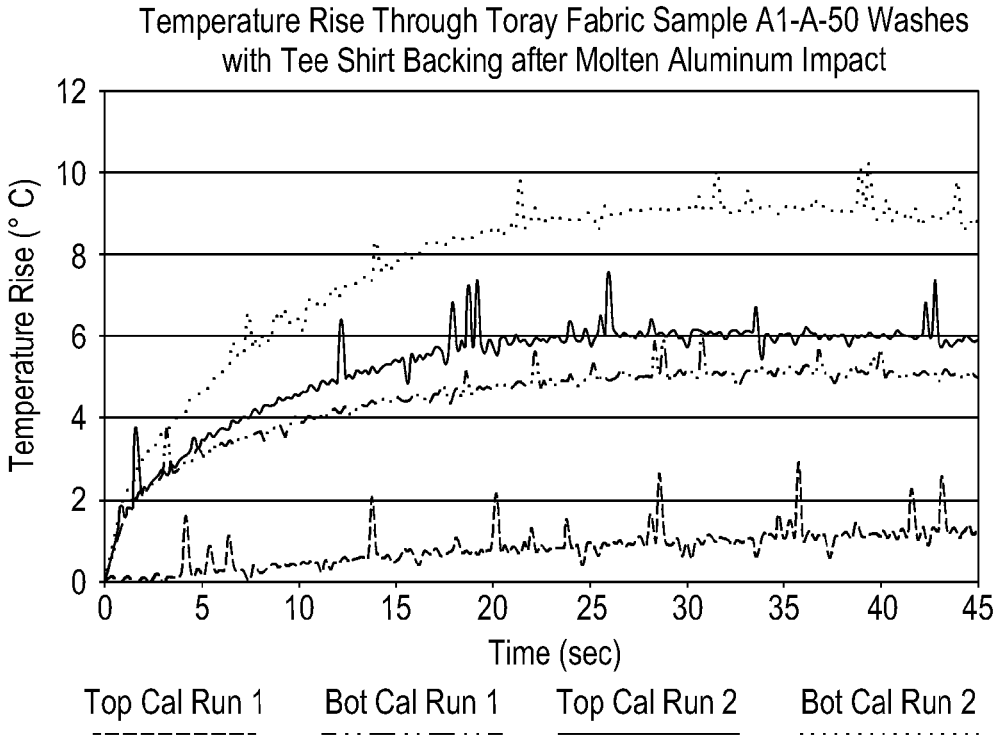
FIG. 4(A) graphically illustrates the temperature rise to a calorimeter through test fabric Al-A-50 washes with tee shirt backing to molten metal impact.
Figure 4B:
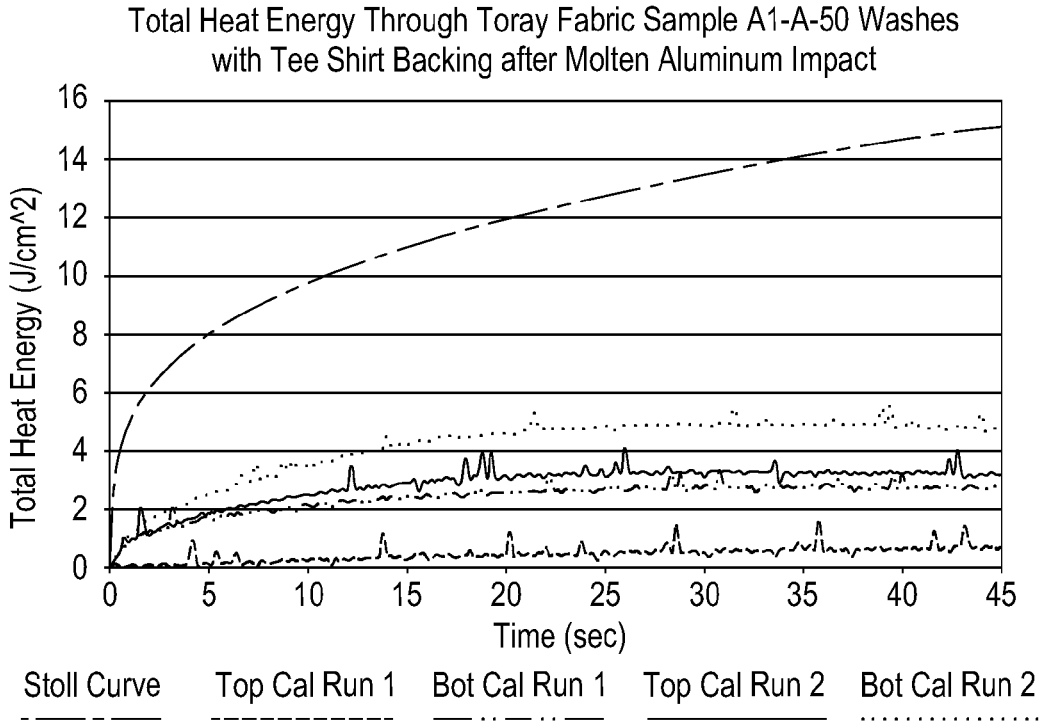
FIG. 4(B) graphically illustrates the total heat energy to a calorimeter through test fabric Al-A-50 washes with tee shirt backing to molten metal impact.
Figure 5A:
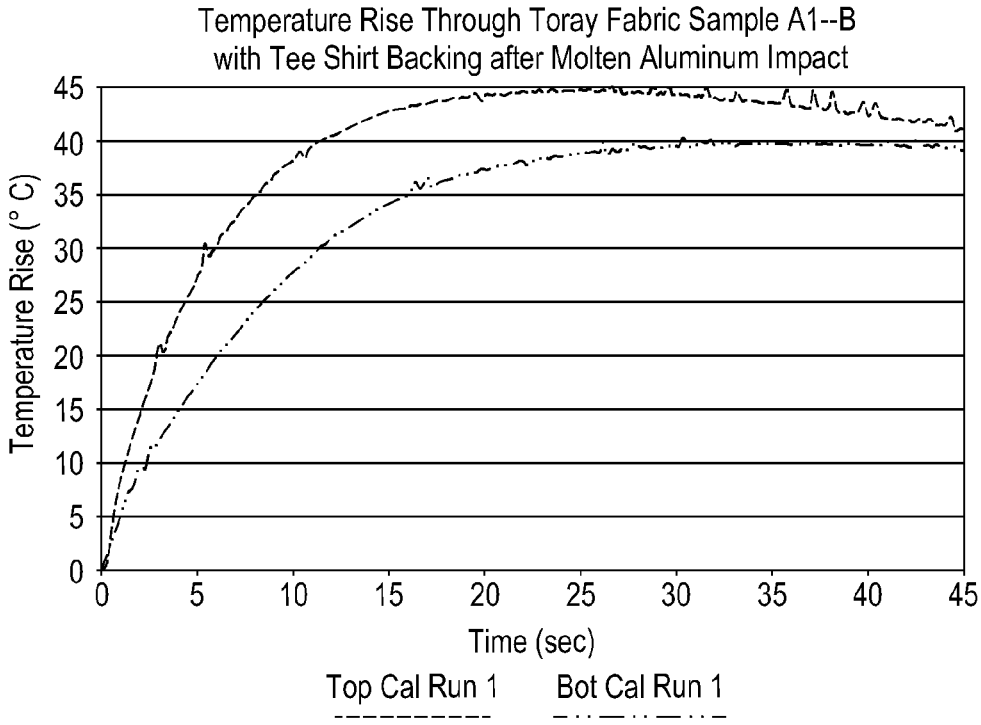
FIG. 5(A) graphically illustrates the temperature rise to a calorimeter through test fabric Al—B washes with tee shirt backing to molten metal impact.
Figure 5B:
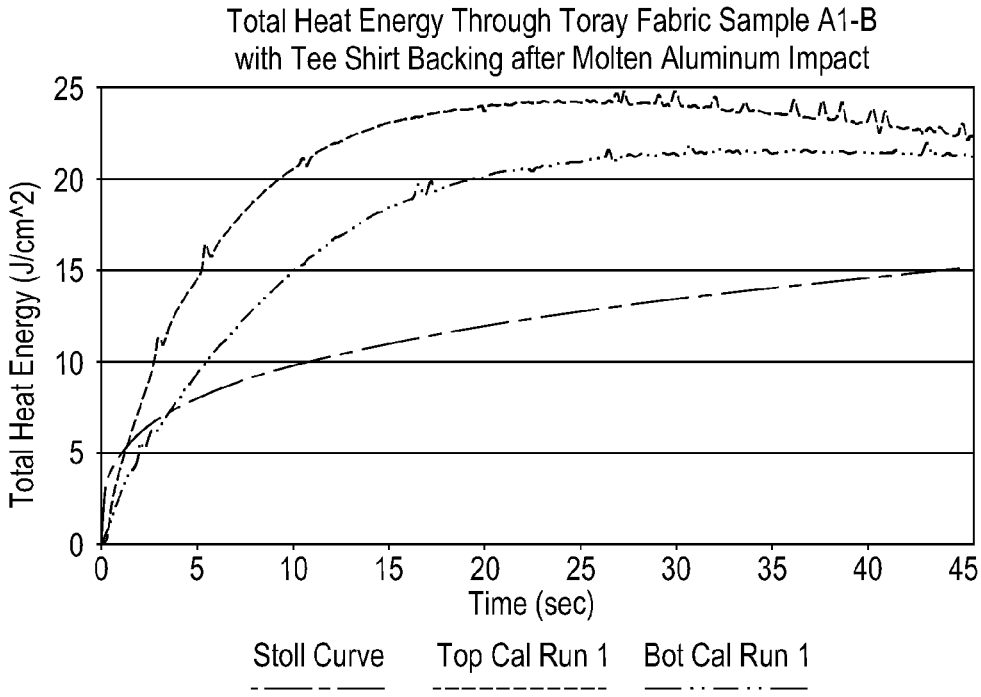
FIG. 5(B) graphically illustrates the total heat energy to a calorimeter through test fabric Al—B washes with tee shirt backing to molten metal impact.
Figure 6A:
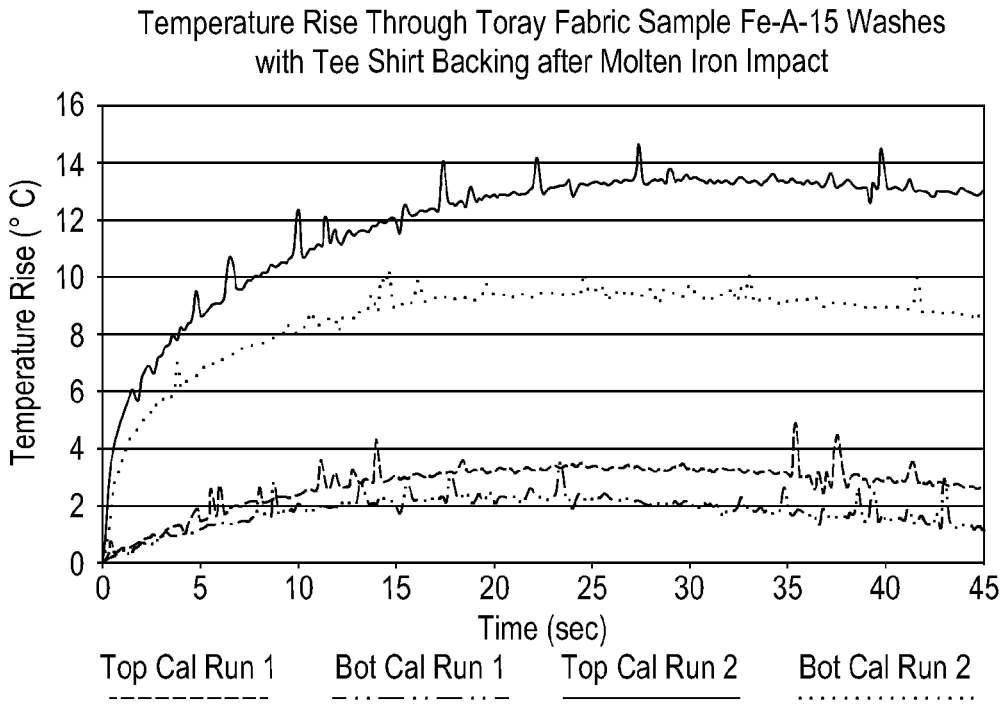
FIG. 6(A) graphically illustrates the temperature rise to a calorimeter through test fabric Fe-A-15 washes with tee shirt backing to molten metal impact.
Figure 6B:
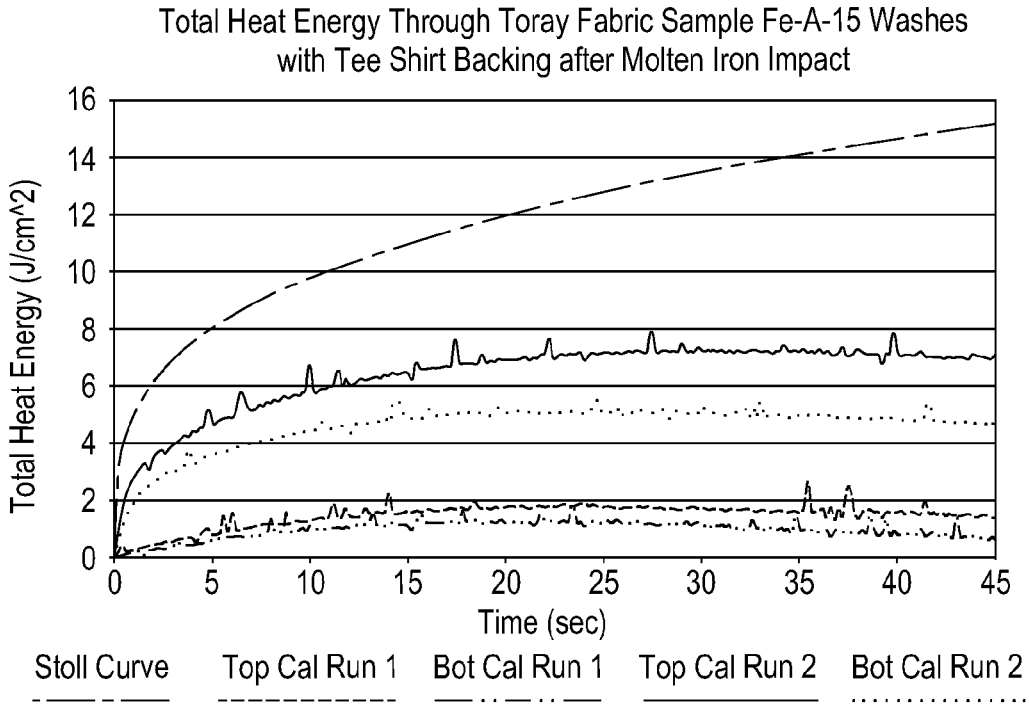
FIG. 6(B) graphically illustrates the total heat energy to a calorimeter through test fabric Fe-A-15 washes with tee shirt backing to molten metal impact.

The present invention is directed to a protective, lightweight garment made of a fabric having an exterior surface that can repeatedly and readily shed molten metal splash and sparks and resists burn-through caused thereby. Preferably, the garment is in the form of a jump suit 10 as depicted in FIG. 1. The garment can also be in the form of a coat, pants, gloves, a welding bib, protective head gear, leggings, apron, arm sleeves, shoe spats, protective footwear or drapes.

In order to quickly shed molten metal splash and the like, the protective garment is constructed of a tightly woven fabric made from spun fluoropolymer staple yarn. By spun fluoropolymer staple yarn it is meant yam which is made by cutting continuous filament fluoropolymer yarn or a continuous tow to a specified length to make a staple fiber and then processing it through common cotton system equipment to form a yarn from the staple. Common method used to make staple yam include ring-spinning, open-end spinning, and air-jet spinning.

By fluoropolymer it is meant a fiber prepared from polymers such as polytetrafluoroethylene, and polymers generally known as fluorinated olefinic polymers, for example, copolymers of tetrafluoroethylene and hexafluoropropene, copolymers of tetrafluoroethylene and perfluoroalkyl-vinyl esters such as perfluoropropyl-vinyl ether and perfluoroethyl-vinyl ether, fluorinated olefinic terpolymers including those of the above-listed monomers and other tetrafluoroethylene based copolymers. For the purposes of this invention, the preferred fluoropolymer fiber is polytetrafluoroethylene fiber.

The fluoropolymer fiber can be spun by a variety of means, depending on the exact fluoropolymer composition desired. Thus, the fibers can be spun by dispersion spinning; that is, a dispersion of insoluble fluoropolymer particles is mixed with a solution of a soluble matrix polymer and this mixture is then coagulated into filaments by extruding the mixture into a coagulation solution in which the matrix polymer becomes insoluble. The insoluble matrix material may later be sintered and removed if desired. One method which is commonly used to spin polytetrafluoroethylene and related polymers includes spinning the polymer from a mixture of an aqueous dispersion of the polymer particles and viscose, where cellulose xanthate is the soluble form of the matrix polymer, as taught for example in U.S. Pat. Nos. 3,655,853; 3,114,672 and 2,772,444. However, the use of viscose suffers from some serious disadvantages. For example, when the fluoropolymer particle and viscose mixture is extruded into a coagulation solution for making the matrix polymer insoluble, the acidic coagulation solution converts the xanthate into unstable xantheic acid groups, which spontaneously lose $CS_2$, an extremely toxic and volatile compound. Preferably, the fluoropolymer fiber of the present invention is prepared using a more environmentally friendly method than those methods utilizing viscose. One such method is described in U.S. Pat. Nos. 5,820,984; 5,762,846, and 5,723,081. In general, this method employs a cellulosic ether polymer such as methylcellulose, hydroxyethylcellulose, methylhydroxypropylcellulose, hydroxypropylmethylcellulose, hydroxypropylcellulose, ethylcellulose or carboxymethylcellulose as the soluble matrix is polymer, in place of viscose. Alternatively, if melt viscosities are amenable, filament may also be spun directly from a melt. Fibers may also be produced by mixing fine powdered fluoropolymer with an extrusion aid, forming this mixture into a billet and extruding the mixture through a die to produce fibers which may have either expanded or unexpanded structures. For the purposes of this invention, the preferred method of making the fluoropolymer fiber is by dispersion spinning where the matrix polymer is a cellulosic ether polymer.

The fluoropolymer fiber can be made into staple using any number of means known in the art. Preferably, the fluoropolymer fiber is cut into staple by a rotating cutter, which is characterized by a rotating movement of a cutting blade as the fluoropolymer fiber tow advances at a constant speed.

To fabricate the protective garment, a tightly-woven fabric is produced from the spun fluoropolymer staple yarn using any means known in the art. It is essential that the work surface of the fabric, that is the exposed surface of the fabric, presents a closed surface so that intrusion of molten metal, when splashed on the garment, cannot occur. The surface should be smooth with no openings which would permit intrusion of splashed molten metal. When properly constructed the surface will readily shed molten metals such as molten aluminum and iron. It is also essential that only fluoropolymer fibers be present on the surface of the garment, since other fibers will encourage sticking of molten metal to the surface of the garment or ignite with consequent harm to the wearer.

Having a surface exhibiting such a low coefficient of friction, metal splash is quickly shed from the garment and therefore in contact with the garment for a very short time. As a result, the heat inherent in the metal splash does not have sufficient time to transmit through the garment and harm its wearer. For this reason, the protective garment of the present invention can be formed from a single fabric layer including only the spun fluoropolymer staple yarn without use of an inner or outer barrier for preventing the transmission of heat through the fabric. That said, is it contemplated that additional layers be added to the garment or worn by a metal worker for increased safety. Further, it is contemplated that the protective garment include portions that include multiple layers of fabric or other protective fabrics where it is likely that molten metal splash can gather and puddle on the surface of the garment and other portions that include only a single layer of the fabric of the present invention where puddles of molten metal splash are not likely to occur, e.g., on the back panel of jumpsuit 10. Thus, the fabric of the present invention allows for the production of a lightweight, compact protective garments.

Tests were undertaken to determine the response of seven fabrics made in accordance with the present invention to controlled impact by molten aluminum and iron. These tests were performed following the procedures of ASTM standard F955-03 entitled "Evaluating Heat Transfer through Materials for Protective Clothing upon Contact with Molten Substances."

Five of the seven fabrics are designated hereafter as Toray-Al or Toray-Fe. The Al designation indicates that the fabric was tested using molten aluminum, and the Fe designation indicates that the fabric was testing using molten iron. Each of these fabrics was made from a plain woven, 13/2 ply cotton count yarn. The yarn was a 50/50 blend of TEFLON® brand 3.5 denier per filament staple fibers and polyvinyl alcohol staple fibers that are water soluble. The fabrics had an initial thread count of about 48 by 48 threads per square inch and a weight of about 11.56 ounces per square yard. After the polyvinyl is alcohol was dissolved out in an initial wash, each of the fabrics had thread count of about 56 by 56 threads per square inch, a weight of about 10.2 ounces per square yard and a thickness of about 0.033 inch.

Following the initial wash and prior to testing, the Toray-Al and Toray-Fe fabrics were later washed between 4 and 49 times in order to test the impact washing has on the properties of the fabrics. In particular, the Toray-Al designated fabrics were washed 5, 25 and 50 times, resulting in Toray-Al-A-5 fabric, Toray-Al-A-25 fabric and Toray-Al-A-50 fabric, respectively. The Toray-Fe designated fabrics were washed either 15 or 35 times resulting in Toray-Fe-A-15 fabric and Toray-Fe-A-35 fabric.

Two of the seven fabrics are designated hereafter as Toray-Al—B and Toray-Fe—B. These fabrics were prepared from a yam having a glass fiber core surrounded by a polytetrafluoroethylene sheath.

The standardized conditions for the molten aluminum impact evaluations consisted of pouring 1 kg. (2.2 lbs.)±0.1 kg of molten aluminum at a minimum temperature of 760 C (1400° F.) onto the fabric samples attached to a calorimeter board. The standardized conditions for the molten iron impact evaluations consisted of pouring 1 kg. (2.2 lbs.) ±0.1 kg of molten iron at a minimum temperature of 1538 C (2800° F.) onto the fabric samples attached to a calorimeter board. The calorimeter board was oriented at an angle of 70° from the horizontal and metal dropped from a height of 12 inches onto each of the fabric samples placed over a calorimeter. The crucible containing the molten metal was rotated against a rigid stop and the metal dumped onto the fabrics.

Each fabric was placed on the calorimeter board and held in place with clips along the upper edge. A preheated ladle was filled with molten aluminum or iron from an is induction furnace held at a temperature of approximately 52 C (125° F.) above the target temperature. The metal weight was determined with an electronic balance and was maintained at 1 kg.±0.1 kg. The filled ladle was transferred to the ladle holder and splashed onto the fabric. A fixed delay of 20 seconds after the start of the furnace pour was used to maintain a consistent metal impact temperature. Empirical testing showed that metal temperature decreased by approximately 24-38 C (75-100° F.) after the 20 second delay. The metal was poured from the ladle onto the fabrics and the results assessed. Each fabric was tested using an under-garment consisting of a single layer of all-cotton tee-shirt.

After impact, the fabrics were visually examined and rated according to the amount of charring, shrinkage, metal adherence, and perforation produced by the metal. The temperature rise in a calorimeter located behind the fabrics was used to calculate the amount of heat transferred through the fabrics.

Visual Examination

The visual appearance of each experimental fabric was subjectively rated in four categories after impact with the molten metals. These categories were charring, shrinkage, metal adherence, and perforation. The rating system uses numbers one through five in each category, with "1" representing the best behavior and "5" representing poor behavior.

The char rating describes the extent of scorching, charring, or burning sustained by the fabric. The five grades used in evaluating the extent of charring: 1=slight scorching, fabric had small brown areas; 2=slight charring, fabric was mostly brown in impacted area; 3=moderate charring, fabric was mostly black in impacted area; 4=charred, fabric was black and brittle, cracked when bent; and 5=severely charred, large holes or cracks, very brittle.

The shrinkage rating provides an indication of the extent of the fabric wrinkling caused by shrinkage occurring around the area of metal impact. It is desirable to have a minimum amount of charring, wrinkling, and shrinkage during or after. Shrinkage was evaluated by laying the fabric on a flat surface and observing the extent of fabric wrinkling around the splash area. Shrinkage was evaluated using five categories: 1=no shrinkage; 2=slight shrinkage; 3=moderate shrinkage; 4=significant shrinkage; and 5=extensive shrinkage.

Metal adherence refers to the amount of metal sticking to the fabric, and the perforation rating describes the extent of fabric destruction in terms of the size, number of holes created, and penetration of molten metal through the fabric. It is desirable to have no perforation or penetration of molten metal through the fabric. Adherence of the metal was rated using five categories: 1=none; 2=small amount of metal adhered to face or back of fabric; 3=a moderate amount of metal adhered to the fabric; 4=substantial adherence of the metal to the fabric; and 5=large amount of adherence of metal to the fabric. Perforation was rated using 5 categories: 1=none; 2=slight, small holes impacted area; 3=moderate, holes in fabric; 4=metal penetration through the fabric, some metal retained on the fabric; and 5=heavy perforation, the fabric exhibited gaping holes or large cracks or substantial metal penetration to the back side

Heat Transfer Data Collection and Interpretation

The refractory board to which the fabrics were attached was constructed according to ASTM standard F955-03. The board contained two 4 cm (1.57 inch) diameter, 1/16 is inch thick, copper disks. One copper disk was located under the point of molten metal impact, and the second was located 4 inches below the first. Each copper disk calorimeter contained a single 30-gauge iron/constantan Type J thermocouple inserted into the back of the calorimeter. The thermocouple output from the calorimeter was recorded with a high precision digital data acquisition system.

The temperature rise for both calorimeters was plotted for forty-five seconds for each fabric/metal combination. The total heat energy that flowed through the fabric was calculated at each time step using the following formula:

$$Q = \frac{m \times C_p \times (Temp_{final} - Temp_{initial})}{\text{Area}}$$

where:

Q=heat energy (J/cm$^2$), m=mass of copper slug (g),

Cp=average heat capacity of copper during the temperature rise (J/g° C.), $Temp_{final}$=final temperature of calorimeter at $time_{final}$ (° C.), $Temp_{initial}$=initial temperature of calorimeter at $time_{initial}$ (° C.), Area=area of copper calorimeter.

This heat energy curve was compared to an empirical human predicted second-degree skin burn injury model (Stoll Curve). (A. M. Stoll and L. C. Greene, "The Relationship Between Pain and Tissue Damage due to Thermal Irradiation," J. Applied Physiology. 14, May 1959, 376-382; A. M. Stoll and M. A. Chianta, "Method and Rating System for Evaluation of Thermal Protection," Aerospace Medicine, November 1969, 1232-1238; A. M. Stoll and M. A. Chianta, "Heat Transfer Through Fabrics as Related to Thermal Injury," Trans. New York Academy of Science, 1971, 649-671). The Stoll curve is calculated from the following formula.

$$\text{Stoll Curve (J/cm}^2\text{)} = 5.0204 \times t_j^{0.2901}$$

where $t_j$ is the time after molten metal impact.

Results and Discussion

The average visual rating of each of the four fabric combinations after molten aluminum impact is presented in Table I.

TABLE I

Average Visual Rating of Fabrics* Exposed to Molten Aluminum Rating of Outer (Impacted) Layer

| Mat. No. | Material Designation* | Charring | Shrinkage | Adherence | Perforation |
|---|---|---|---|---|---|
| 1 | Toray-A1-A-5 Washes | 3 | 2 | 1 | 1 |
| 2 | Toray-A1-A-25 Washes | 3 | 2 | 1 | 1 |
| 3 | Toray-A1-A-50 Washes | 3 | 2 | 1 | 1 |
| 4 | Toray-A1-B | 4 | 1 | 4 | 4 |

*Fabric layup: Single Layer over tee shirt.

The best fabrics in terms of average visual appearance were Toray-Al-A-5 Washes, Toray-Al-A-25 Washes, and Toray-Al-A-50 Washes with moderate charring in the molten aluminum impact area, slight shrinkage, and no adherence or perforation. The worst fabric in terms of visual appearance was Toray-Al—B which was charred in the impact area, no shrinkage, significant metal adherence, and had metal penetration thru the fabric in the impact area. The individual rating for each fabric sample is listed in Table II.

TABLE II

Visual Rating of Fabrics* Exposed to Molten Aluminum Rating of Outer (Impacted) Layer

| Mat. No. | Material Designation | Charring | Shrinkage | Adherence | Perforation |
|---|---|---|---|---|---|
| 1 | Toray-A1-A-5 Washes Run 1 | 3 | 2 | 1 | 1 |
| | Toray-A1-A-5 Washes Run 2 | 3 | 2 | 1 | 1 |
| 2 | Toray-A1-A-25 Washes Run 1 | 3 | 2 | 1 | 1 |
| | Toray-A1-A-25 Washes Run 2 | 3 | 2 | 1 | 1 |
| 3 | Toray-A1-A-50 Washes Run 1 | 3 | 2 | 1 | 1 |
| | Toray-A1-A-50 Washes Run 2 | 3 | 2 | 1 | 1 |
| 4 | Toray-A1-B Run 1 | 4 | 1 | 2 | 2 |

*Fabric layup: Single Layer over tee shirt.

The average visual rating of each of the three fabric combinations after molten iron impact is presented in Table III.

TABLE III

Average Visual Rating of Fabrics* Exposed to Molten Aluminum Rating of Outer (Impacted) Layer

| Mat. No. | Material Designation* | Charring | Shrinkage | Adherence | Perforation |
|---|---|---|---|---|---|
| 1 | Toray-Fe-A-15 Washes | 3 | 1 | 1 | 2 |
| 2 | Toray-Fe-A-35 Washes | 3 | 1 | 1 | 2 |
| 3 | Toray-Fe-B | 5 | 1 | 1 | 5 |

*Fabric layup: Single Layer over tee shirt.

The best fabric in terms of average visual appearance were Toray-Fe-A-15 Washes and Toray-Fe-A-35 Washes with moderate charring in the molten iron impact area, no shrinkage, no adherence and slight perforation in the metal impact area. The worst fabric in terms of visual appearance was Toray-Fe—B which was severely charred in the impact area, no shrinkage, no metal adherence, and had heavy metal penetration thru the fabric in the impact area. The individual rating for each fabric sample is listed in Table IV.

TABLE IV

Visual Rating of Fabrics* Exposed to Molten Iron Rating of Outer (Impacted) Layer

| Mat. No. | Material Designation | Charring | Shrinkage | Adherence | Perforation |
|---|---|---|---|---|---|
| 1 | Toray-Fe-A-15 Washes Run 1 | 3 | 1 | 1 | 1 |
| | Toray-Fe-A-15 Washes Run 2 | 3 | 1 | 1 | 2 |
| 2 | Toray-Fe-A-35 Washes Run 1 | 3 | 1 | 1 | 2 |
| | Toray-Fe-A-35 Washes Run 2 | 3 | 1 | 1 | 1 |
| 3 | Toray-Fe-B Run 1 | 5 | 1 | 1 | 5 |

*Fabric layup: Single Layer over tee shirt.

A summary of the calorimeter data, including the maximum calorimeter temperature rise within 30 second after molten aluminum impact and the time to second degree burn according to the Stoll curve, is given in Table V.

TABLE V

Maximum Calorimeter Temperature Rise during the First 30 Second and Time to Second Degree Burn According to the Stoll Curve after Impact With Molten Aluminum.

| Burn | | Rise (C.) after 30 sec | | According to |
|---|---|---|---|---|
| Mat. No. | Material Designation* | Top Cal | Bottom Cal | Stoll Curve (sec) |
| 1 | Toray-A1-A-5 Washes | 7.1 | 10.8 | None |
| 2 | Toray-A1-A-25 Washes | 9.2 | 9.7 | None |
| 3 | Toray-A1-A-50 Washes | 7.6 | 9.8 | None |
| 4 | Toray-A1-B | 45.7 | 39.7 | 1.4 |

*Fabric layup: Single Layer over tee shirt.

All fabrics were tested over a single layer of all-cotton tee-shirt material. Table V provides the material designation, maximum temperature rise during thirty seconds after molten metal impact from the top and bottom calorimeter, and the shortest time to second degree burn from the runs for each fabric combination. The best fabrics in terms of maximum heat rise and time to second degree burn were Toray-Al-A-5 Washes, Toray-Al-A-25 Washes, and Toray-Al-A-50 Washes with a maximum temperature rise ranging from 7.1 to 10.8° C. and no second degree burn. Toray-Al—B had a maximum thermal rise of 45.7° C. and a second degree burn after 1.4 seconds according to the Stoll curve. The individual values for each fabric sample is listed in Table VI.

TABLE VI

Maximum Calorimeter Temperature Rise during the First 30 Second and Time to Second Degree Burn According to the Stoll Curve after Impact With Molten Aluminum.

| Burn | | Rise (C.) after 30 sec | | According to |
|---|---|---|---|---|
| Mat. No. | Material Designation* | Top Cal | Bottom Cal | Stoll Curve (sec) |
| 1 | Toray-A1-A-5 Washes Run 1 | 6.5 | 9.8 | None |
| | Toray-A1-A-5 Washes Run 2 | 7.1 | 10.8 | None |
| 2 | Toray-A1-A-25 Washes Run 1 | 9.2 | 9.7 | None |
| | Toray-A1-A-25 Washes Run 2 | 2.7 | 3.8 | None |
| 3 | Toray-A1-A-50 Washes Run 1 | 2.7 | 5.9 | None |
| | Toray-A1-A-50 Washes Run 2 | 7.6 | 9.8 | None |
| 4 | Toray-A1-B Washes Run 1 | 45.7 | 39.7 | 1.4 |

*Fabric layup: Single Layer over tee shirt.

A summary of the calorimeter data, including the maximum calorimeter temperature rise within 30 second after molten iron impact and the time to second degree burn according to the Stoll curve, is given in Table VII.

TABLE VII

Maximum Calorimeter Temperature Rise during the First 30 Second and Time to Second Degree Burn According to the Stoll Curve after Impact With Molten Iron.

| Burn | | Rise (C.) after 30 sec | | According to |
|---|---|---|---|---|
| Mat. No. | Material Designation* | Top Cal | Bottom Cal | Stoll Curve (sec) |
| 1 | Toray-Fe-A-15 Washes | 14.6 | 10.2 | None |
| 2 | Toray-Fe-A-35 Washes | 12.9 | 8.1 | None |
| 3 | Toray-Fe-B | 33.6 | 64.4 | 0.6 |

TABLE VII-continued

Maximum Calorimeter Temperature Rise during the First 30 Second and Time to Second Degree Burn According to the Stoll Curve after Impact With Molten Iron.

| Burn | | Rise (C.) after 30 sec | | According to |
|---|---|---|---|---|
| Mat. No. | Material Designation* | Top Cal | Bottom Cal | Stoll Curve (sec) |

*Fabric layup: Single Layer over tee shirt.

All fabrics were tested over a single layer of all-cotton tee-shirt material. The best is fabrics in terms of maximum heat rise and time to second degree burn were Toray-Fe-A-15 Washes and Toray-Fe-A-35 Washes with a maximum temperature rise ranging from 8.1 to 14.6° C. and no second degree burn. Toray-Fe—B had a maximum thermal rise of 64.4° C. and a second degree burn after 0.6 seconds according to the Stoll curve. The individual values for each fabric sample is listed in Table VIII.

TABLE VIII

Maximum Calorimeter Temperature Rise during the First 30 Second and Time to Second Degree Burn According to the Stoll Curve after Impact With Molten Iron.

| Burn | | Rise (C.) after 30 sec | | According to |
|---|---|---|---|---|
| Mat. No. | Material Designation* | Top Cal | Bottom Cal | Stoll Curve (sec) |
| 1 | Toray-Fe-A-15 Washes Run 1 | 4.3 | 3.4 | None |
| | Toray-Fe-A-15 Washes Run 2 | 14.6 | 10.2 | None |
| 2 | Toray-Fe-A-35 Washes Run 1 | 6.2 | 4.6 | None |
| | Toray-Fe-A-35 Washes Run 2 | 12.9 | 8.1 | None |
| 3 | Toray-Fe-B Washes Run 1 | 33.6 | 64.4 | 0.6 |

*Fabric layup: Single Layer over tee shirt.

Figure 7A:
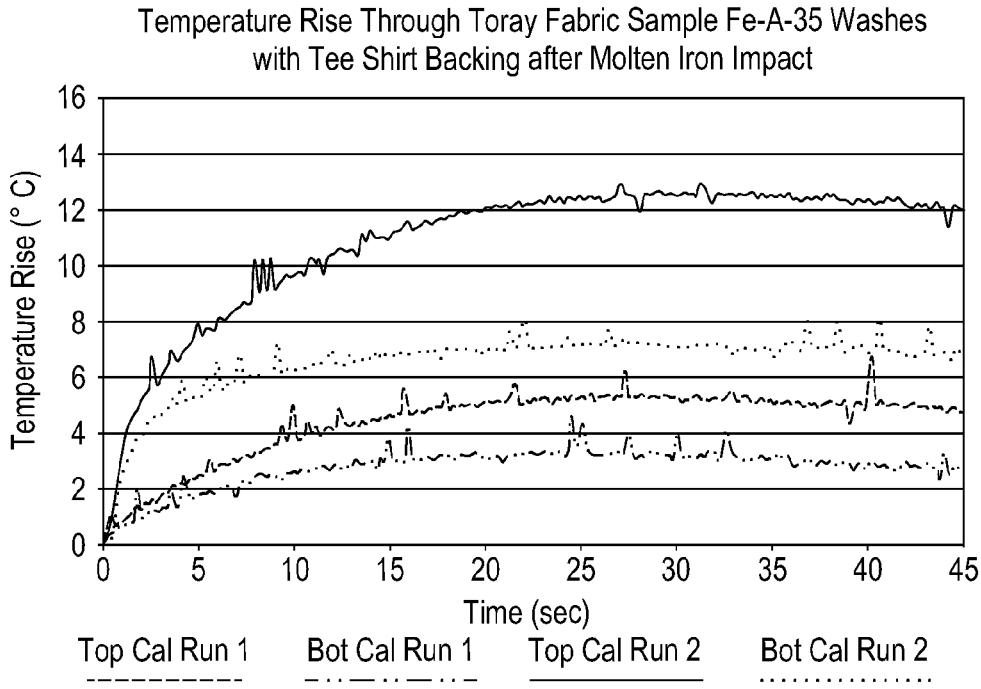
FIG. 7(A) graphically illustrates the temperature rise to a calorimeter through test fabric Fe-A-35 washes with tee shirt backing to molten metal impact.
Figure 7B:
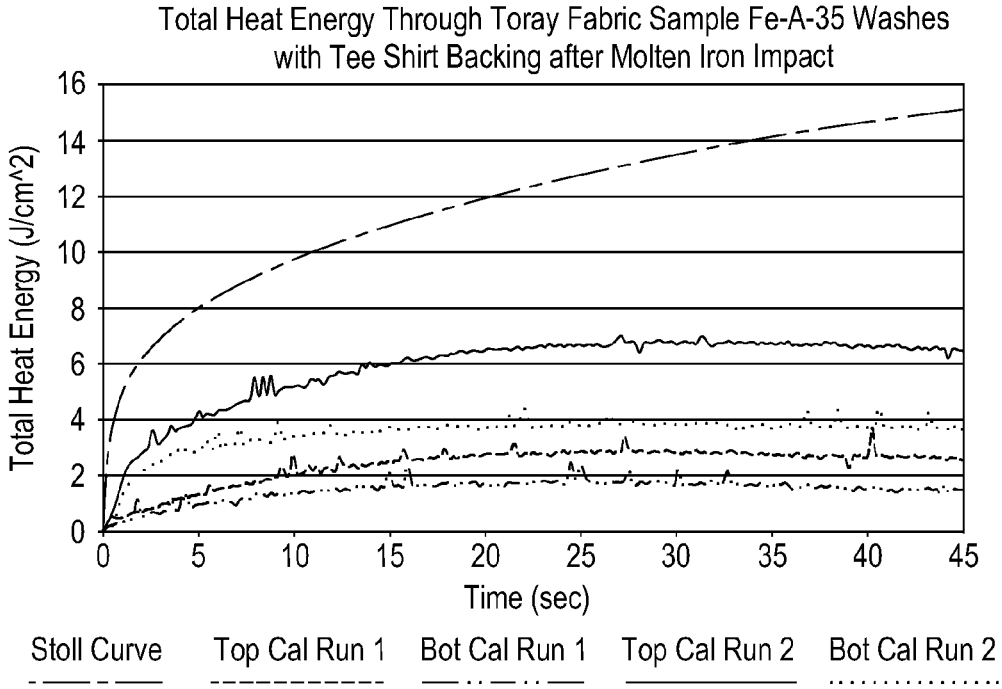
FIG. 7(B) graphically illustrates the total heat energy to a calorimeter through test fabric Fe-A-35 washes with tee shirt backing to molten metal impact.
Figure 8A:
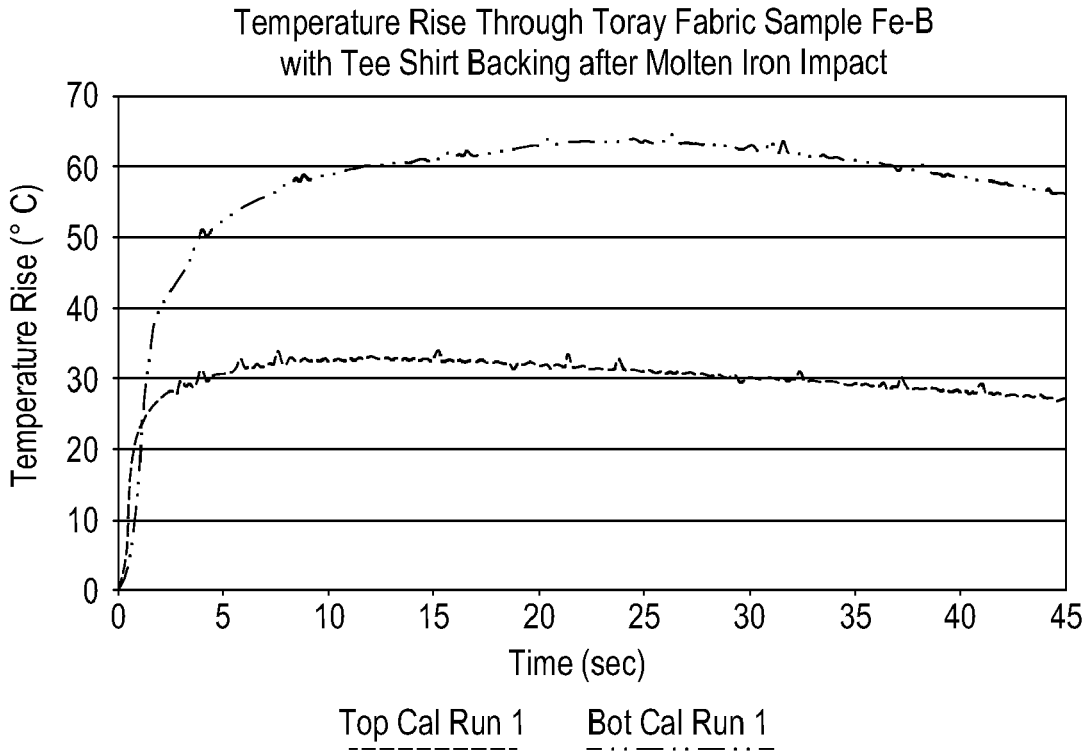
FIG. 8(A) graphically illustrates the temperature rise to a calorimeter through test fabric Fe—B washes with tee shirt backing to molten metal impact.
Figure 8B:
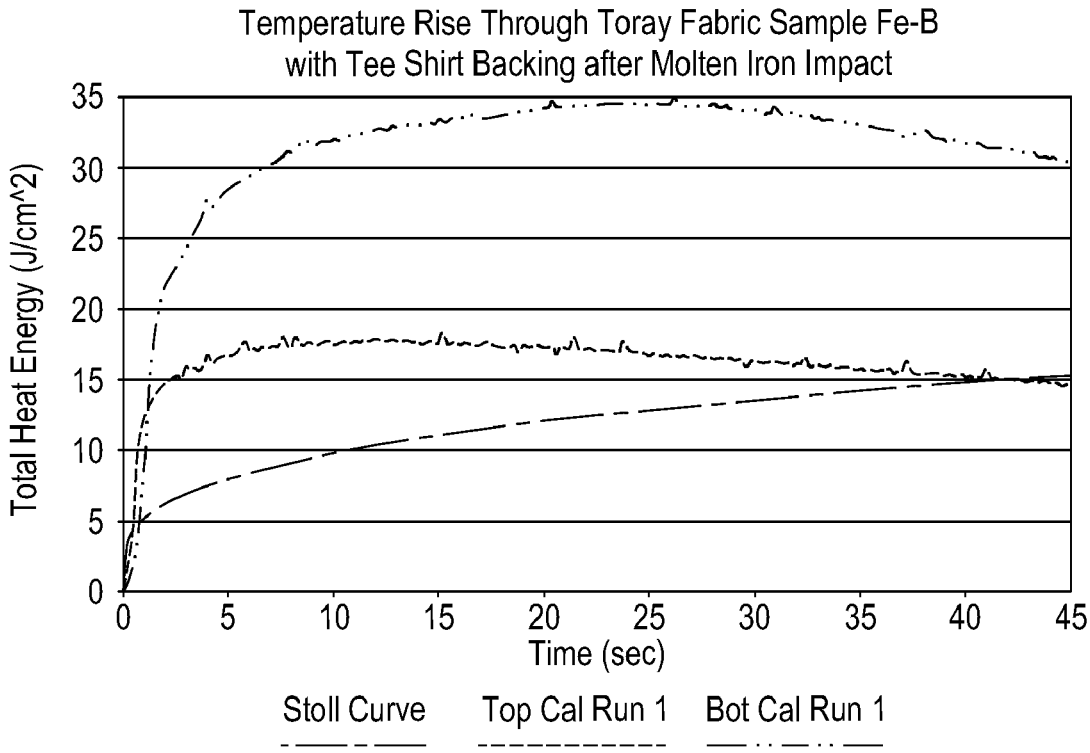
FIG. 8(B) graphically illustrates the total heat energy to a calorimeter through test fabric Fe—B washes with tee shirt backing to molten metal impact.

Graphs of the temperature rise and total heat energy through each fabric are illustrated in FIGS. 3 through 6 for all four fabric combinations subjected to molten aluminum impact. Graphs of the temperature rise and total heat energy through each fabric subjected to molten iron impact are illustrated in FIGS. 7 through 9 for all three fabric combinations.

Findings

The best fabrics in terms of average visual appearance after molten aluminum impact were Toray-Al-A-5 Washes, Toray-Al-A-25 Washes, and Toray-Al-A-50 Washes with moderate charring in the impact area, slight shrinkage, and no adherence or perforation. The worst fabric in terms of visual appearance was Toray-Al—B which was charred in the impact area, no shrinkage, significant metal adherence, and had metal penetration thru the fabric in the impact area. The best fabric in terms of average visual appearance after molten iron impact were Toray-Fe-A-15 Washes and Toray-Fe-A-35 Washes with moderate charring in the impact area, no shrinkage, no adherence and slight perforation in the metal impact area. The worst fabric in terms of visual appearance was Toray-Fe—B which was severely charred in the impact area, no shrinkage, no metal adherence, and had heavy metal penetration thru the fabric in the impact area.

The best fabrics in terms of maximum heat rise and time to second degree burn after molten aluminum impact were Toray-Al-A-5 Washes, Toray-Al-A-25 Washes, and Toray-Al-A-50 Washes with a maximum temperature rise ranging from 7.1 to 10.8° C. and no second degree burn. Toray-Al—B had a maximum thermal rise of 45.7° C. and a second degree burn after 1.4 seconds according to the Stoll curve.

The best fabrics in terms of maximum heat rise and time to second degree burn is after molten iron impact were Toray-Fe-A-15 Washes and Toray-Fe-A-35 Washes with a maximum temperature rise ranging from 8.1 to 14.6° C. and no second degree burn. Toray-Fe—B had a maximum thermal rise of 64.4° C. and a second degree burn after 0.6 seconds according to the Stoll curve.

As will be apparent to one skilled in the art, various modifications can be made within the scope of the aforesaid description. Such modifications being within the ability of one skilled in the art form a part of the present invention and are embraced by the claims below.

It is claimed:

1. A garment for readily shedding a molten metal splash comprising, a single layer of fabric prepared from a single layer of woven, spun fluoropolymer staple yarn, wherein the garment excludes an inner heat resistant fabric layer adapted and arranged for preventing the transmission of heat through the garment, and wherein the yarn is about 100% by weight of polytetrafluoroethylene staple fibers.

2. A garment for readily shedding a molten metal splash comprising, a single layer of fabric prepared from a single layer of woven, spun fluoropolymer staple yarn, wherein the garment excludes an inner heat resistant fabric layer adapted and arranged for preventing the transmission of heat through the garment, wherein the single layer of fabric has a weight in the range of about 8.0 ounces per square yard to about 11.56 ounces per square yard, and wherein the single layer of fabric has at least one of a thickness of about 0.033 inch and a thread count in the range of about 48 by about 48 threads per square inch to about 56 by about 56 threads per square inch.

3. A garment for readily shedding a molten metal splash comprising, a single layer of fabric prepared from a single layer of woven, spun fluoropolymer staple yarn, wherein the garment excludes an inner heat resistant fabric layer adapted and arranged for preventing the transmission of heat through the garment, wherein the single layer of fabric has a weight in the range of about 8.0 ounces per square yard to about 11.56 ounces per square yard, and wherein the single layer of fabric exhibits a maximum temperature rise in the range from 7.1° C. to 14.6° C. when subjected to the molten metal splash in accordance with ASTM standard F955-03.

4. A method of manufacturing a garment that resists adherence thereto by a molten metal splash comprising, spinning a yarn from polytetrafluoroethylene staple fibers, wherein the yarn includes about 15% to about 50% by weight of polyvinyl alcohol staple fibers, weaving the yarn, producing a woven fabric from the yarn, the woven fabric including a single layer of the woven yarn, fabricating the garment from the fabric, excluding from the garment a heat resistant fabric layer that is in addition to the woven fabric, and removing essentially all of the polyvinyl alcohol staple fibers from the fabric.

5. The method according to claim 4 wherein the garment comprises a single layer.

6. The method according to claim 4 wherein the single layer exhibits a maximum temperature rise in the range from 7.1° C. to 14.6° C. when subjected to molten metal splash in accordance with ASTM standard F955-03.

7. The method according to claim 4 wherein the fabric fails to exhibit at least two of fabric shrinkage, fabric perforation and molten metal adherence when subjected to molten metal splash in accordance with ASTM standard F955-03.

8. A method of manufacturing a garment that resists adherence thereto by a molten metal splash comprising, spinning a yarn from polytetrafluoroethylene staple fibers, weaving the yarn, producing a woven fabric from the yarn, the woven fabric including a single layer of the woven yarn, fabricating the garment from the fabric, and excluding from the garment a heat resistant fabric layer that is in addition to the woven fabric, wherein the yarn is about 100% by weight of the polytetrafluoroethylene staple fibers.

9. A method of manufacturing a garment that resists adherence thereto by a molten metal splash comprising, spinning a yarn from polytetrafluoroethylene staple fibers, weaving the yarn, producing a woven fabric from the yarn, the woven fabric including a single layer of the woven yarn, fabricating the garment from the fabric, and excluding from the garment a heat resistant fabric layer that is in addition to the woven fabric, wherein the fabric has a thickness of about 0.033 inch and a weight in the range of about 10.2 ounces per square yard to about 11.56 ounces per square yard.

10. A garment for shedding a molten metal splash comprising, a fabric including about 100% by weight of a woven spun polytetrafluoroethylene staple fiber yarn, wherein a single layer of the fabric exhibits a maximum temperature rise of less than about 14.6° C. when subjected to molten metal splash in accordance with ASTM standard F955-03 and the garment excludes an inner heat resistant fabric layer adapted and arranged for preventing the transmission of heat through the garment.

11. The garment according to claim 10 wherein the fabric has at least one of a thickness of about 0.033 inch, a thread count in the range of about 48 by about 48 threads per square inch to about 56 by about 56 threads per square inch and a weight in the range of about 10.2 ounces per square yard to about 11.56 ounces per square yard.

12. The garment according to claim 10 wherein the fabric fails to exhibit at least two of fabric shrinkage, fabric perforation and molten metal adherence when subjected to molten metal splash in accordance with ASTM standard F955-03.

13. The garment according to claim 10 essentially comprised of one layer.

14. The garment according to claim 10 wherein the yarn is prepared from staple fibers having linear densities ranging from about 0.1 to about 8.0 denier per filament with an average denier equal to or less than 7 denier per filament.

15. The garment according to claim 14 wherein the staple fibers have an average denier equal to or less than 4 denier per filament.

16. The fabric according to claim 10 wherein the molten metal is one or more of aluminum and iron.

17. The garment according to claim 10 wherein the yarn is prepared from a blend of course and fine denier staple fibers.

* * * * *